US010347167B2

(12) United States Patent
Kuo et al.

(10) Patent No.: US 10,347,167 B2
(45) Date of Patent: Jul. 9, 2019

(54) IMAGE DRIVING METHOD AND SYSTEM USING THE SAME

(71) Applicant: ACER INCORPORATED, New Taipei (TW)

(72) Inventors: Jin-Ting Kuo, New Taipei (TW); Chih-Chiang Chen, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 15/725,286

(22) Filed: Oct. 5, 2017

(65) Prior Publication Data

US 2018/0366048 A1 Dec. 20, 2018

(30) Foreign Application Priority Data

Jun. 15, 2017 (TW) ..... 106119906 A

(51) Int. Cl.
*G09G 3/20* (2006.01)

(52) U.S. Cl.
CPC ... *G09G 3/2003* (2013.01); *G09G 2320/0261* (2013.01); *G09G 2320/0276* (2013.01); *G09G 2320/0673* (2013.01); *G09G 2330/021* (2013.01); *G09G 2340/0435* (2013.01)

(58) Field of Classification Search
CPC ..... G09G 3/2003; G09G 2320/0261; G09G 2320/0276; G09G 2320/00673; G09G 2330/021; G09G 2340/0435
See application file for complete search history.

(56) References Cited

U.S. PATENT DOCUMENTS 6,144,770 A * 11/2000 Lennon ..... G09G 3/3629 382/232
7,283,108 B2 * 10/2007 Kasai ..... G09G 3/3233 315/169.3
2004/0155841 A1 * 8/2004 Kasai ..... G09G 3/3233 345/76
2006/0139289 A1 * 6/2006 Yoshida ..... G09G 3/342 345/98
2006/0158410 A1 * 7/2006 Fujine ..... G09G 3/3611 345/89
2009/0244112 A1 10/2009 Jung
2012/0001964 A1 * 1/2012 Masuda ..... G09G 3/3413 345/690

FOREIGN PATENT DOCUMENTS

TW 201714407 A 4/2017

* cited by examiner

*Primary Examiner* — Mihir K Rayan
(74) *Attorney, Agent, or Firm* — Winston Hsu

(57) ABSTRACT

An image driving method is disclosed. The image driving method includes obtaining an output image signal, determining whether an image frame difference exists according to an N image frame and an N+1 image frame of the output image signal, and determining an image frame difference region according to the image frame difference, and driving pixel units corresponding to the image frame difference region with the impulse type driving.

10 Claims, 6 Drawing Sheets

IMAGE DRIVING METHOD AND SYSTEM USING THE SAME

BACKGROUND OF THE INVENTION

1. Field of the Invention

The present invention relates to an image driving method and system using the same, and more particularly, to a driving image driving method capable of switching driving type and the image driving system using the same.

2. Description of the Prior Art

In recent years, with the dramatically development of virtual reality (VR) technology, The VR application is fast becoming a popular trend among consumers and has been widely used in various fields, such as entertainment, sport training, medical, military training. According to the latest survey report, there are now more than 20 million VR head-mounted displays (HMDs) are widely used. In general, a cathode ray tube (CRT) display uses an impulse type driving method for displaying images, and a liquid crystal display (LCD) or an organic light emitting diode display (OLED) uses a hold type driving method for displaying images.

Moreover, most of the HMDs use the LCD type screens or the OLED type screens for display. However, since the screens are quite close to a user's eyes when the HMD is worn on the user's head and the LCD type screens or the OLED type screens using the hold type driving method have a drawback of causing a motion blur problem while displaying images, this may result in the uncomfortable viewing experience for the user. Besides, if the LCD or the OLED uses the impulse type driving method for displaying images, the power consumption may be greatly increased. Therefore, how to solve the above mentioned problems has become an important issue in the field.

SUMMARY OF THE INVENTION

It is therefore an objective of the present invention to provide an image driving method and an image driving system for switching image driving type for enhancing quality of dynamic images and reducing system power consumption, so as to solve the above mentioned problems.

The present invention discloses an image driving method, comprising: obtaining an output image signal; determining whether an image frame difference exists according to the Nth image frame and the (N+1) th image frame of the output image signal; and determining an image frame difference region according to the image frame difference, and driving pixel units corresponding to the image frame difference region with impulse type driving.

The present invention further discloses an image driving system, comprising: a plurality of pixel units; and a control device, coupled to the plurality of pixel units, for obtaining an output image signal, determining whether an image frame difference exists according to the Nth image frame and the (N+1)th image frame of the output image signal, determining an image frame difference region according to the image frame difference, and driving pixel units corresponding to the image frame difference region with impulse type driving.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
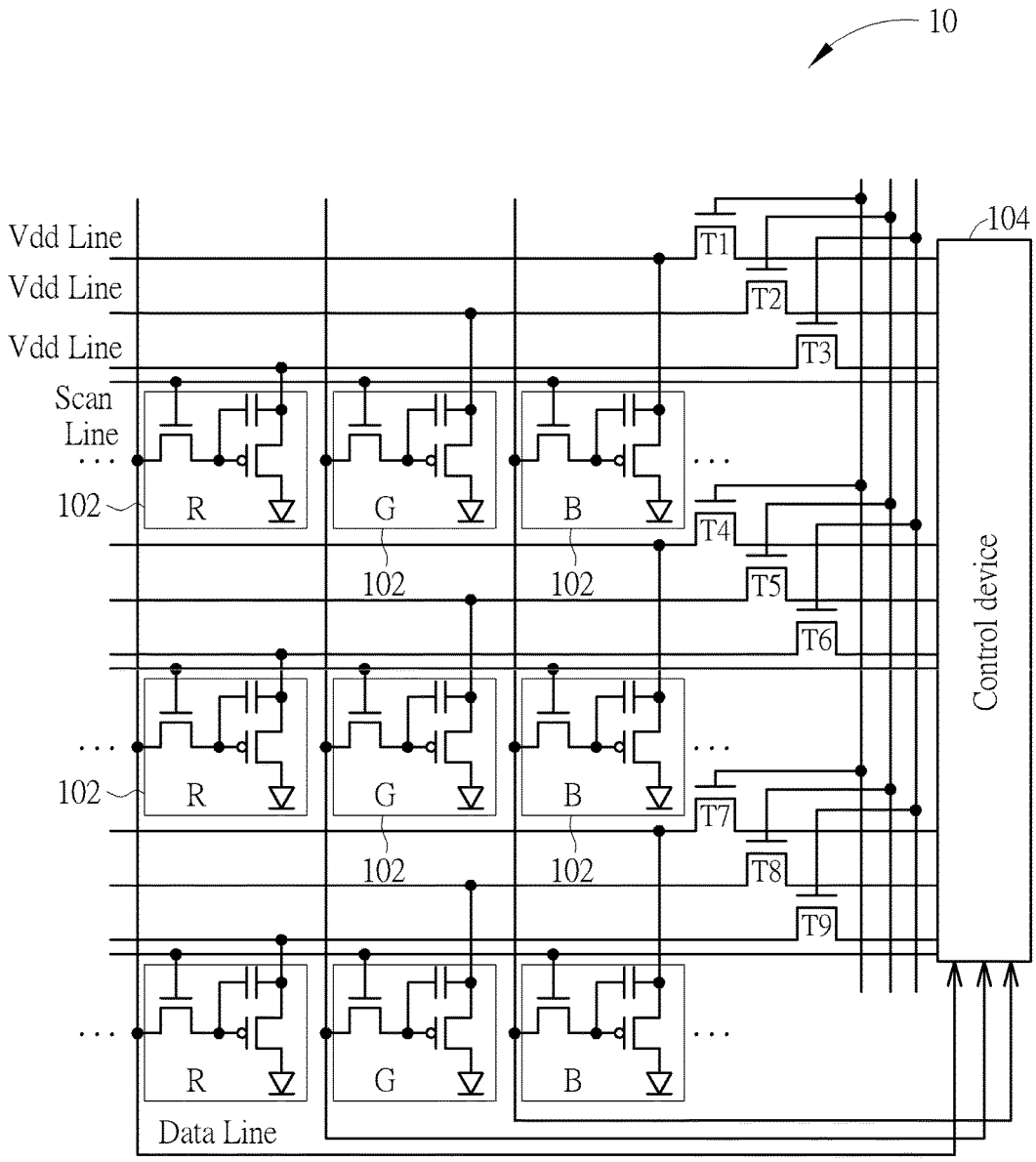
FIG. 1 is a schematic diagram of an image driving system according to an exemplary embodiment of the present invention.

Please refer to FIG. 1, which is a schematic diagram of an image driving system 10 according to an exemplary embodiment of the present invention. The image driving system 10 includes a plurality of pixel units 102, a control device 104, switch units T1-Tn, a plurality of data lines (Data Line), a plurality of voltage lines (Vdd Line) and a plurality of scan lines (Scan Line). For example, the image driving system 10 can be applied in an organic light emitting diode (OLED) display system, a liquid crystal display (LCD) system, a micro LED system, and this should not be a limitation of the present invention. Each pixel unit 102 may include a pixel or a sub-pixel, such as an R (red) pixel, a G (green) pixel or a B (blue) pixel. The switch units T1-Tn are coupled to the pixel units 102 and the control device 104. The control device 104 can switch driving scheme types of the pixel units 102 via turning on or turning off the switch units T1-Tn, such that signals can be transmitted to the pixel units 102 via the data lines (Data Line), the voltage lines (Vdd Line) and the scan lines (Scan Line). The voltage lines (Vdd Line) can be utilized for providing voltages for the image driving system 10 via gate lines (not shown in figure).

Moreover, the control device 104 can obtain an output image signal, determine whether an image frame difference region D exists according to the Nth image frame and the (N+1)th image frame of the output image signal, and drive the pixel units 102 corresponding to the image frame difference region D with the impulse type driving. When the output image signal varies with frames and the current frame is different from the previous frame (i.e., frames of the output image signal are dynamic images), the region occurring frame variations occur between the previous frame and the current frame can be driven with the impulse type driving. In an embodiment, the control device 104 may be a graphics processing unit (GPU), a processor of a driver, a video card device, or any other related image signal processing chip, so that the control device 104 can receive output image signal from a computer system and accordingly control to drive pixel units corresponding to the image frame difference region D with the impulse type driving by turning on or turning off the switch units T1-Tn.

Figure 2:
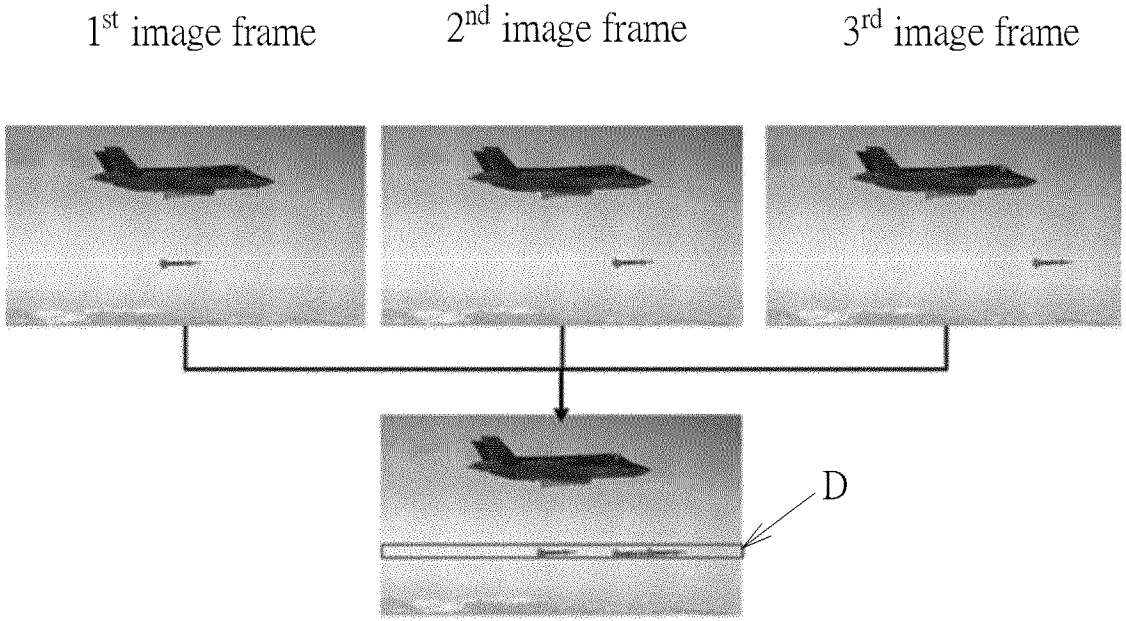
FIG. 2 is a schematic diagram of output image signals according to an exemplary embodiment of the present invention.

For example, please refer to FIG. 2, which is a schematic diagram of output image signals according to an exemplary embodiment of the present invention. The output image signal includes a first image frame at a first time point, a second image frame at a second time point and a third image frame at a third time point. After receiving an output image signal (e.g., the output image signal shown in FIG. 2), the control device 104 of the image driving system 10 determines that an image frame difference region D exists in the first image frame, the second image frame and the third image frame and determines that the switch units T4-T6 correspond to the image frame difference region D. As such, the control device 104 turns on the switch units T4-T6 and therefore drives the pixel unit 102 of the gate lines corresponding to the image frame difference region D with the impulse type driving. For example, the control device 104 turns on the switch units T4-T6 and drives the pixel units 102 of the gate lines corresponding to the image frame difference region D with the impulse type driving, and the pixel units 102 of the gate lines corresponding to the switch units T1-T3, T7-T9 (corresponding to a region with no image frame difference) are still driven with the hold-type driving. Note that, the control device 104 can determine a frequency and a voltage value of a switch signal of each pixel unit of the gate lines of the image frame difference region D according to the image frame difference region D. Thus, in the above-mentioned embodiments, the control device 104 transmits the switch signals corresponding to the switch units T4-T6 and the switch signals include switch frequencies and voltage values of the switch units T4-T6 for compensating a color or a gamma curve of each pixel unit of the gate lines of the image frame difference region D. As shown in FIG. 2, the switch signals corresponding to the switch units T4-T6 may change with switch frequencies and voltage values. Therefore, the image driving system 10 can change driving types of the pixel units via the switch units T1-Tn of the control device 104, and the motion blur and image retention are thus reduced.

Please note that, the image driving system 10 is an exemplary embodiment of the present invention, and those skilled in the art can make alternations and modifications accordingly. For example, the image driving system 10 can be designed according to various system requirements. For example, the driving types of the pixel units can be the impulse-type driving, the hold-type driving or any other driving types and the control device 104 can use different frequencies and voltage values to control switch units, thus enhancing the quality of output images and reducing power consumption of the image driving system 10.

Figure 3:
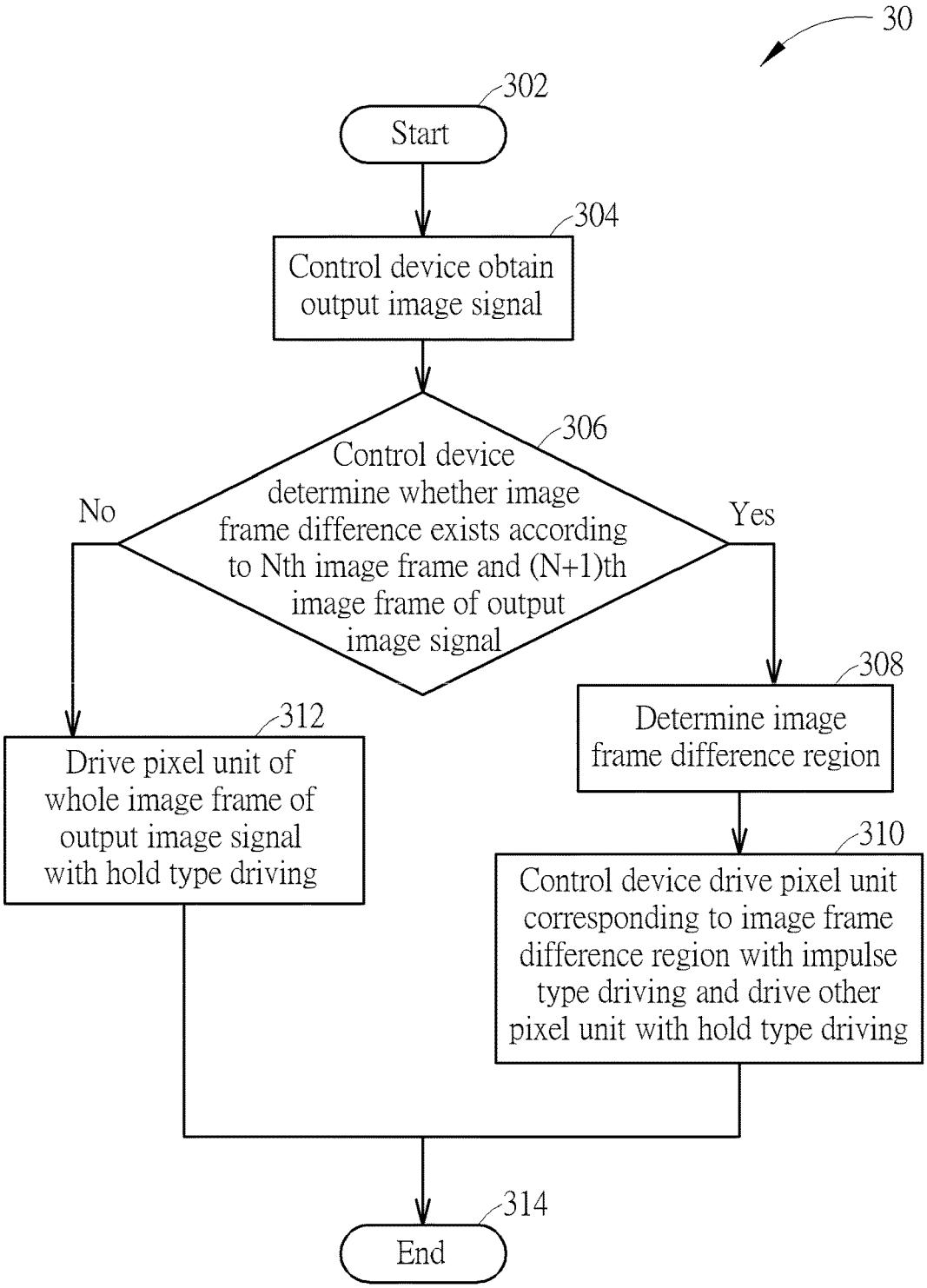
FIG. 3 is a schematic diagram of a procedure according to an embodiment of the present invention.

Regarding an image driving method of the image driving system 10, the image driving method may be summarized in an exemplary procedure 30. Please refer to FIG. 3, which is a schematic diagram of the procedure 30 according to an embodiment of the present invention. The procedure 30 includes the following steps:

Step 302: Start.

Step 304: Control device 104 obtain output image signal.

Step 306: Control device 104 determine whether image frame difference exists according to Nth image frame and (N+1) th image frame of output image signal; if yes, go to Step 308; otherwise, go to Step 312.

Step 308: Determine image frame difference region D.

Step 310: Control device 104 drive pixel unit 102 corresponding to image frame difference region D with impulse type driving.

Step 312: Drive pixel unit 102 of whole image frame of output image signal with-hold type driving.

Step 314: End.

In an embodiment, in Step 304, the control device 104 obtains the output image signal. In Step 306, the control device 104 can determine whether an image frame difference exists according to the Nth image frame and the (N+1) th image frame of the output image signal. If the control device 104 determines that an image frame difference exists, Step 308 is performed for determining an image frame difference region D. In Step 310, the control device 104 drives the pixel units 102 of gate lines corresponding to the image frame difference region D with the impulse type driving and drives the pixel units 102 of the other gate lines (the gate lines except for gate lines corresponding to the image frame difference region D) with the hold type driving. In addition, in Step 306, if the control device 104 determines that no image frame difference exists, Step 312 is performed for driving the pixel units 102 of all gate lines of the output image signal with the hold type driving. For example, the control device 104 can perform the impulse type driving with different frequencies and voltage values via the switch units T1-Tn corresponding to the pixel units 102 of the gate lines of the image frame difference region D for driving the pixel units 102. Since the pixel units 102 of the gate lines corresponding to the image frame difference region D are driven with different frequencies and voltage values, colors and gamma curves of the pixel units 102 can be compensated accordingly, thus reducing the power consumption of the image driving system 10. Note that, switching timing (turn-on time and/or turn-off time), switching frequencies, and voltage values of the switch units T1-Tn may be determined by using lookup table methods or determined by the control device 104 or the computer system.

Figure 4:
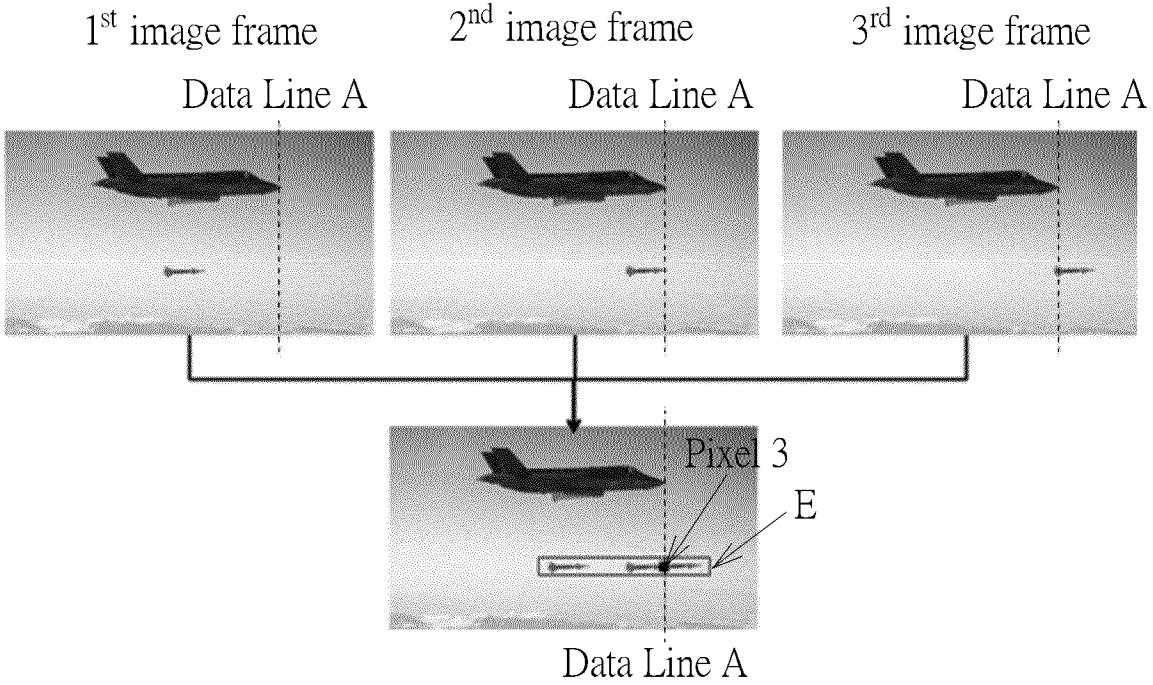
FIG. 4 is a schematic diagram of output image signals according to an alternative exemplary embodiment of the present invention.

For reducing the range of the image frame difference region and further reducing the power consumption of the image driving system 10, the following illustrates an alternative embodiment of the invention. In an alternative embodiment, according to the procedure 30, the control device 104 can drive the pixel units 102 of data lines corresponding to the image frame difference region D with the impulse type driving. Please refer to FIG. 4. When the control device 104 of the image driving system 10 obtains the output image signal shown in FIG. 4. The control device 104 determines that an image frame difference region E exists in the first image frame, the second image frame and the third image frame. Since the image frame difference region E correspond to the pixel units 102 of the gate lines and the pixel units 102 of the data lines, respectively, the control device 104 can drive the pixel units 102 by driving the gate lines and/or the data lines for compensating the image frame difference region E.

Figure 5:
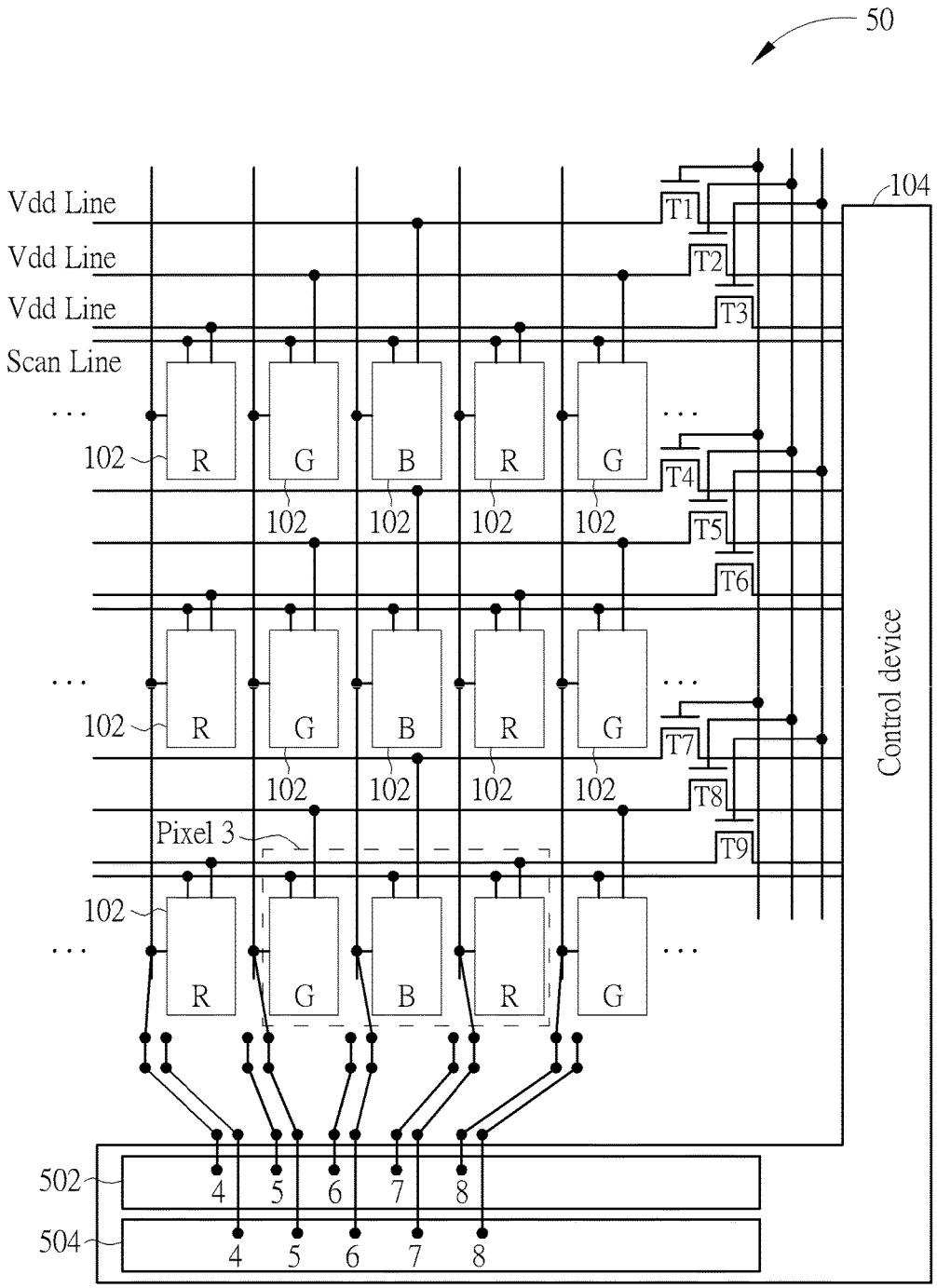
FIG. 5 is a schematic diagram of an image driving system according to an alternative exemplary embodiment of the present invention.
Figure 6:
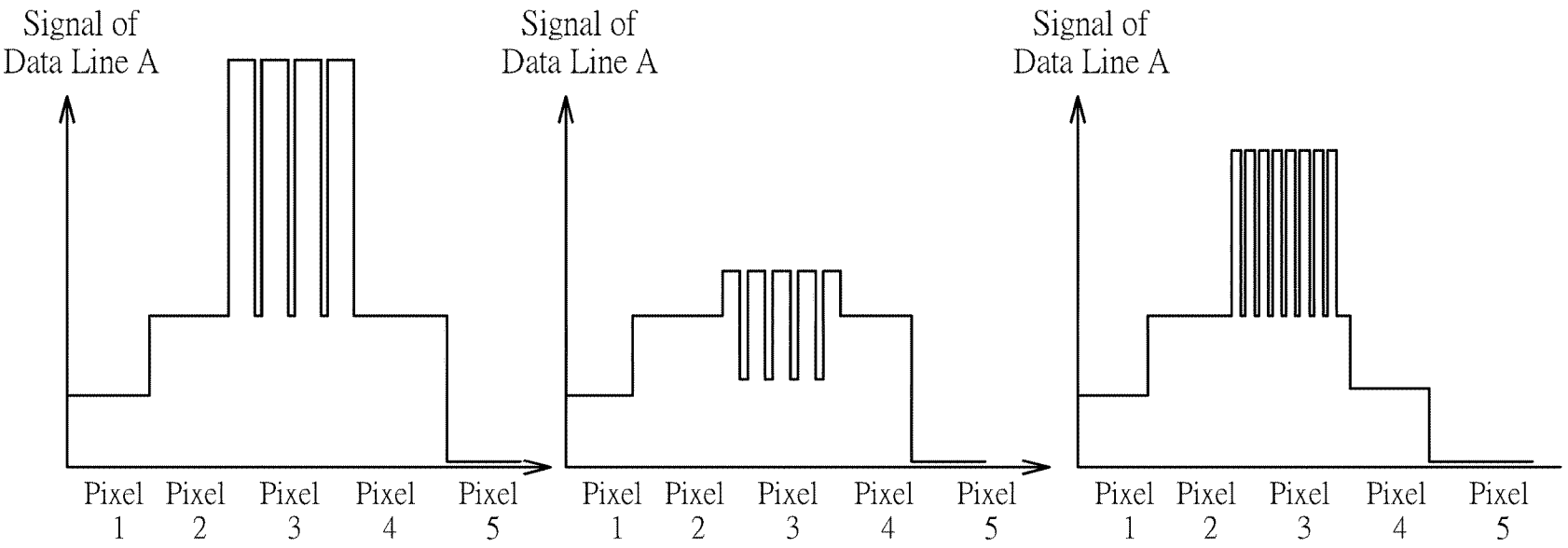
FIG. 6 is a schematic diagram of signals of data line according to an exemplary embodiment of the present invention.

Moreover, please refer to FIG. 5, which is a schematic diagram of an image driving system 50 according to an exemplary embodiment of the present invention. Note that the units in the image driving system 50 shown in FIG. 5 with the same designations as those in the image driving system 10 shown in FIG. 1 have similar operations and functions, and further description thereof is omitted for brevity. The interconnections of the units are as shown in FIG. 5. Different from the image driving system 10 shown in FIG. 1, the image driving system. 50 further includes a hold type driver 502 and an impulse type driver 504 for switching driving types of source data of data lines. Via the hold type driver 502 and the impulse type driver 504, the image driving system 50 can switch different driving types for driving pixel units. For example, when the control device 104 obtains the output image signal and determines that an image frame difference region E exists in the first image frame, the second image frame and the third image frame, the control device 104 generates the switch signal with different frequencies and voltage values to turn on or turn off the switch units T1-Tn for compensating the pixel units 102 corresponding to the image frame difference region E. The image driving system 50 can drive the pixel units 102 corresponding to the image frame difference region E with the impulse type driving by switching control the hold type driver 502 and the impulse type driver 504. In an embodiment, the pixel units 102 corresponding to the region Pixel 3 can be driven with the impulse type driving, that is, the node 5 to node 7 of the impulse type driver 504 can be connected to the data lines (data line). Please refer to FIG. 6, which is a signal diagram of a data line A of the first image frame, the second image frame and the third image frame shown in FIG. 4. The control device 104 can switch the connection of the data lines (data line), the hold type driver 502 and the impulse type driver 504, and thus drive the data line A with the impulse type driving to output the data of the region Pixel 3 for compensating colors of the region Pixel 3 and maintaining the color brightness and reducing motion blur and image retention. The control device 104 can drive the other pixel units 102 (the pixel units except for the region Pixel 3) with the hold type driving. Therefore, the image driving system of the invention can adjust and compensate the colors of pixel units for maintaining image quality of the dynamic images, reducing the range of the image frame difference region and reducing the power consumption.

Note that, the image driving systems 10 and 50, the image driving procedure 30 are exemplary embodiments of the present invention and those skilled in the art can make alterations and modifications accordingly. For example, switching timing (turn-on time and/or turn-off time), switching frequencies, and voltage values of the switch units may be determined by using lookup table methods or determined by the user or the system. The control device 104 may be a GPU, a processor of a driver, a video card device, or any other related image signal processing chip. Pixel amount or a pixel combination of pixel units corresponds to the image frame difference region can be modified based on system requirements.

In summary, the image driving method and related image driving system of the invention can switch various driving types for driving the corresponding pixel units according to image frame differences, thus reducing the motion blur and image retention, enhancing the quality of the output images and reducing system power consumption.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image driving method, comprising:

obtaining an output image signal;

determining whether an image frame difference exists according to the Nth image frame and the (N+1)th image frame of the output image signal; and determining an image frame difference region according to the image frame difference, and driving pixel units corresponding to the image frame difference region with impulse type driving, and driving pixel units outside of the image frame difference region with hold type driving; and determining a switch signal of each pixel unit of the gate lines of the image frame difference region according to the image frame difference region to compensate a color or a gamma curve of the each pixel unit of the gate lines of the image frame difference region;

wherein each of the pixel units within the image frame difference region is individually driven with the impulse type driving;

wherein the switch signal comprises a frequency and a voltage value of the switch signal of the each of pixel units of the gate lines within the image frame difference region.

2. The image driving method of claim 1, wherein the step of driving the pixel units corresponding to the image frame difference region with the impulse type driving comprises:

driving the pixel units of gate lines corresponding to the image frame difference region with the impulse type driving.

3. The image driving method of claim 1, further comprising:

determining a switch signal of each pixel unit of the gate lines of the image frame difference region according to the image frame difference region.

4. The image driving method of claim 3, wherein the switch signal comprises a frequency and a voltage value of the switch signal of the each pixel unit of the gate lines of the image frame difference region.

5. The image driving method of claim 3, wherein the switch signal is utilized for compensating a color or a gamma curve of each pixel unit of the gate lines of the image frame difference region.

6. An image driving system, comprising:

a plurality of pixel units; and a control device, coupled to the plurality of pixel units, for obtaining an output image signal, determining whether an image frame difference exists according to the Nth image frame and the (N+1)th image frame of the output image signal, determining an image frame difference region according to the image frame difference, and driving pixel units corresponding to the image frame difference region with impulse type driving, and driving pixel units outside of the image frame difference region with hold type driving; and determining a switch signal of each pixel unit of the gate lines of the image frame difference region according to the image frame difference region to compensate a color or a gamma curve of the each pixel unit of the gate lines of the image frame difference region; wherein each of the pixel units within the image frame difference region is individually driven with the impulse type driving; wherein the switch signal comprises a frequency and a voltage value of the switch signal of the each of pixel units of the gate lines within the image frame difference region.

7. The image driving system of claim 6, wherein the control device drives the pixel units of gate lines corresponding to the image frame difference region with the impulse type driving.

8. The image driving system of claim 6, wherein the control device determines a switch signal of each pixel unit of the gate lines of the image frame difference region according to the image frame difference region.

9. The image driving system of claim 8, wherein the switch signal comprises a frequency and a voltage value of the switch signal of the each pixel unit of the gate lines of the image frame difference region.

10. The image driving system of claim 8, wherein the switch signal is utilized for compensating a color or a gamma curve of each pixel unit of the gate lines of the image frame difference region.

* * * * *